US006386406B1

(12) United States Patent
Moses

(10) Patent No.: US 6,386,406 B1
(45) Date of Patent: May 14, 2002

(54) GARMENT HANGER

(76) Inventor: Daniel Moses, 12258 N. York, Sterling Heights, MI (US) 19020

( * ) Notice: Subject to any disclaimer, the term of this patent is extended or adjusted under 35 U.S.C. 154(b) by 0 days.

(21) Appl. No.: 09/907,759

(22) Filed: Jul. 18, 2001

(51) Int. Cl.[7] ..... A47G 25/14
(52) U.S. Cl. ..... 223/85
(58) Field of Search ..... 223/85, DIG. 4, 223/92; D6/315, 316, 317, 318, 328

(56) References Cited

U.S. PATENT DOCUMENTS 5,586,697 A * 12/1996 Johansson ..... 223/85

* cited by examiner

*Primary Examiner*—John J. Calvert
*Assistant Examiner*—James G Smith
(74) *Attorney, Agent, or Firm*—Michael I. Kroll

(57) ABSTRACT

An improved garment hanger is provided, in several embodiments, that reduces the likelihood of the hanger being dislocated from the supporting hanger rack when the hanger is moving vertically as a result of the release of stored energy when garments are removed from the hanger. Various individual blocking members are provided on the different embodiments with several of the embodiments being particularly drawn to applications on typical plastic and wire hangers. Some blocking member configurations are particularly suited for reducing the degree of pivot by the hanger when supported by a hook-shaped hanger rack.

1 Claim, 10 Drawing Sheets

GARMENT HANGER

BACKGROUND OF THE INVENTION

1. Field of the Invention

The present invention relates generally to garment hangers.

2. Description of the Prior Art

There are other garment hangers designed for hanger retention. Typical of these is U.S. Pat. No. 1,740,566 issued to Batts on Nov. 18, 1926.

Another patent was issued to Flocco on Dec. 17, 1935 as U.S. Pat. No. 2,024,442. Yet another U.S. Pat. No. 2,637,472 was issued to Lyons on May 5, 1953 and still yet another was issued on Nov. 8, 1955 to Carr as U.S. Pat. No. 2,723,063.

Another patent was issued to Richards on Nov. 8, 1955 as U.S. Pat. No. 2,723,064. Yet another U.S. Pat. No. 2,723,065 was issued to Vargo on Nov. 8, 1955. Another was issued to Dolnick on Mar. 17, 1959 as U.S. Pat. No. 2,877,939 and still yet another was issued on Mar. 17, 1959 to Pressler. as U.S. Pat. No. 2,877,940.

Another patent was issued to Melone on Mar. 17, 1959 as U.S. Pat. No. 2,877,941. Yet another U.S. Pat. No. 4,801,057 was issued to Heston on Jan. 31, 1989. Another was issued to Morin on Jul. 16, 1985 as U.S. Pat. No. Des. 279,627 and another was issued to Andersson on Apr. 4, 1995 as U.S. Pat. No. Des. 356,894 and still yet another was issued on Apr. 20, 1999 to Eiley et al. as U.S. Pat. No. Des. 408,156.

U.S. Pat. No. 1,740,566

Inventor: Walter H. Batts

Issued: Dec. 24, 1929

The present invention is a garment hanger that will support a suit, including a coat and trousers so that neither of the garments will be wrinkled or stretched out of shape. The garment hanger comprises a wire frame having diverging shoulder members and a horizontal cross member and a cardboard covering folded over the garment hanger having an elongated slot to expose the greater portion of the length of the horizontal lower member.

U.S. Pat. No. 2,024,442

Inventor: Vincent Flocco

Issued: Dec. 17, 1935

The invention is a garment hanger having means for locking or positively retaining the same upon a supporting rod in use. The garment hanger comprises, a garment supporting bar, a hook having a shank portion attached to the bar for support. The hanger has a substantially C-shaped clasp having an open mouth, a flexible connector having one end attached to the free end of the hook and its other end attached to the clasp. The clasp is arranged to receive the shank of the hook through the open mouth, thereby retaining the hanger upon the support and against accidental displacement.

U.S. Pat. No. 2,637,472

Inventor: Leonadus R. Lyons

Issued: May 5, 1953

The invention is a try-on garment hanger adapted to support a dress or similar garment in draped relation on the figure of a person. The garment hanger is bowed out of its bodily plane so as to conform approximately to the curvature of the chest of a person between the shoulders. The collar project upwardly from the upper longitudinal edge of the bow member at the central portion. The collar is comprised of a springy material and normally curved to encircle the sides and back of the neck of a person and support a garment at approximately chest-high elevation.

U.S. Pat. No. 2,723,063

Inventor: Stanly Carr

Issued: Nov. 8, 1955

The present invention is a garment hanger comprising a panel portion and hook for suspending the same from a support member. The hanger includes a spring clip traversing the vertical supporting axis of the hook. The central portion secured to the panel with finger grips attached to the clip to facilitate attachment or removal of garments.

U.S. Pat. No. 2,723,064

Inventor: Rose May Richards

Issued: Nov. 8, 1955

A garment hanger adapted to the support of women's skirts, strapless dresses or other garments. The hanger has a skirt hanger attachment comprised of an elastic band and a ring mounted on each end of the elastic band. The rings are adapted to fit over the outer ends of the hanger. The spring clip at each end of the elastic band provides a means for clamping a garment not having conventional shoulders.

U.S. Pat. No. 2,723,065

Inventor: Joseph Vargo

Issued: Nov. 8, 1955

The present invention is a collapsible coat hanger comprising a center piece and a hook connected to the center piece and extending upwardly. The hanger has a pair of arms with their inner ends adapted to lie flush with the ends of the center piece. The hanger has a leaf spring-like element fixed to the center piece. Each of the arms has a pin that mates with the spring of the center piece when the arms are fully extended. The arms can be lowered by disengaging the arm pin from the support of the center spring.

U.S. Pat. No. 2,877,939

Inventor: Benjamin I. Dolnick

Issued: Mar. 17, 1959

The invention is a garment hanger formed from a single piece of wire bent in the typical triangular fashion including a neck having a supporting hook extending upwardly. As the garment hanger is formed the shoulder support members are bent to form an interior hook and then bent upon themselves returning to the triangular shape. This causes a depression to form on the upper exterior of the shoulder for holding garments with straps.

U.S. Pat. No. 2,877,940

Inventor: Harry B. Pressler

Issued: Mar. 17, 1959

The present invention is a garment hanger that, when hung on a garment support rod, cannot accidentally slip off.

The hanger is comprised of facing adjacent hook elements. Pressing the shank of each hook causes the hooks to separate, therein permitting removal of the garment hanger from the rod.

U.S. Pat. No. 2,877,941

Inventor: James A. Melone

Issued: Mar. 17, 1959

The present invention is a garment hanger having a flexible fixed connection to the hook shank of the garment hanger. The flexible connector has an aperture in the other distal end wherein the connector can be passed onto the hook.

U.S. Pat. No. 4,801,057

Inventor: Krystyna L. Heston

Issued: Jan. 31, 1989

The hanger includes a hook element which extends upwardly from a neck element, two shoulder elements extend downwardly at an angle from the neck element. The lower ends of the shoulder elements are connected by a divided crossbar. Extending outwardly from the ends of the crossbar are shelf-like extensions which are movable into and out of the ends of the crossbar.

U.S. Pat. No. Des. 279,627

Inventor: Nicole Morin

Issued: Jul. 16, 1985

This United States Patent discloses an ornamental design for a garment hanger as illustrated in the drawings of the patent.

U.S. Pat. No. Des. 356,894

Inventor: Per O. Andersson

Issued: Apr. 4, 1995

This United States Patent discloses an ornamental design for a garment hanger as illustrated in the drawings of the patent.

U.S. Pat. No. Des. 408,156

Inventor: Stanley Eiley et al.

Issued: Apr. 20, 1999

This United States Patent discloses an ornamental design for a garment hanger as illustrated in the drawings of the patent.

While these hanger bar retention devices may be suitable for the purposes for which they were designed, they would not be as suitable for the purposes of the present invention, as hereinafter described.

SUMMARY OF THE PRESENT INVENTION

A primary object of the present invention is to provide a garment hanger having a hook and shank with a blocking member spaced between the hook and body of the hanger and forming an integral part of the hanger, the blocking member encountering the hanger rack member during vertical motion of the hanger.

A second object of the present invention is to provide a garment hanger having a hook and shank with a blocking member spaced between the hook and body of the hanger and forming an integral part of the hanger, the blocking member encountering the hanger rack member during pivotal motion of the hanger.

Another object of the present invention is to provide a garment hanger that has a linear or curvilinear element fixed to the shank of the hook.

Yet another object of the present invention is to provide a garment hanger having a linear or curvilinear element that extends substantially through the hook opening.

Still yet another object of the present invention is to provide a garment hanger having a linear or curvilinear element which extends substantially colinearly with the body of the hanger.

Yet another object of the present invention is to provide a garment hanger having a linear or curvilinear element that extends substantially parallel to one of the shoulder members of the garment hanger.

Additional objects of the present invention will appear as the description proceeds.

Normally a garment hanger has a large, centrally disposed hook with a downwardly extending shank that supports a pair of shoulder member upon which garments are placed. The weight of the garments elastically deforms the hanger and when the garment is removed from the hanger while the hanger is still engaging the hanger rack member, the hanger has a tendency to spring off the garment hanger rack member. It is also common where adjacent garments are lifted from the shoulder members while against another garment in a crowded closet.

The present invention overcomes the shortcomings of the prior art, in this regard, by providing a garment hanger that prevents unintended hanger dislocation by having a blocking member extending from the shank and being spaced away from the body of the hanger. The blocking member can take the form of either a linear or a curvilinear element. The purpose is to provide an element that will form a backstop in the vertical plane that stops movement of the hanger in the vertical plane, while permitting movement of the hanger in the horizontal plane. A second purpose is to stop pivotal movement of the hanger about a hook-shaped garment hanger rack member.

There is provided an improved garment hanger of the type having a hook for engagement over a supporting rack member, the hook having a shank and a downwardly facing opening, wherein the improvement comprises: a first and second elongated shoulder member, the first shoulder member joining the shank, the second shoulder member joining the first shoulder member; and a blocking member having a first end attached to the shank and a second end attached to the first shoulder member, the blocking member being shaped such that, as the hanger is moved vertically, the blocking member encounters the rack member.

In another embodiment, the blocking member further comprises a first portion parallel to the first shoulder member and a second portion parallel to the second shoulder member.

In another embodiment, the garment hanger further comprising a cross-member connecting the first and second shoulder members.

There is also provided an improved garment hanger of the type having a hook for engagement over a supporting rack member, the hook having a shank and a downwardly facing opening, wherein the improvement comprises: a first and second elongated shoulder member, each having an end portion; a shoulder connection member having a first end and a second end, the first shoulder member joining the shoulder connection member first end, and the second shoulder member joining the shoulder connection member second end and the shank; and a blocking member having a first end attached to the shank and a second end attached to the first shoulder member, the blocking member being shaped such that, as the hanger is moved vertically, the blocking member encounters the rack member.

In another embodiment, the connecting member is arcuate and positioned such that the arc opens upwardly.

In another embodiment, the garment hanger further comprises a cross-member connecting the first and second shoulder members.

There is also provided an improved garment hanger of the type having a pair of elongated shoulder members and a hook for engagement over a supporting rack member, the hook having a shank and a downwardly facing opening, the shoulder members being attached to the shank, wherein the improvement comprises a blocking member fixedly attached to and extending from the shank, the blocking member being shaped such that, as the hanger is moved vertically, the blocking member encounters the rack member.

In another embodiment, the blocking member is curved such that the blocking member is substantially parallel to the hook.

In another embodiment, the garment hanger further comprises a cross-member connecting the first and second shoulder members.

There is also provided an improved garment hanger of the type having a pair of elongated shoulder members and a hook for engagement over a supporting rack member, the hook having a shank and a downwardly facing opening, the shoulder members being attached to the shank, wherein the improvement comprises a blocking member having a first end attached to the shank and a second end attached to one of the shoulder members, the blocking member being shaped such that, as the hanger is moved vertically, the blocking member encounters the rack member.

In another embodiment, the blocking member further comprises a first, second, third and fourth portion, the first portion extending in a substantially horizontal direction from the shank, the second portion being attached to the first portion and extending downwardly, the third portion being attached to the second portion and extending in a substantially horizontal direction toward the shank, the fourth portion being attached to the third portion and extending downwardly for further attachment to the first shoulder member.

In another embodiment, the blocking member further comprises a first portion parallel to the first shoulder member and a second portion parallel to the second shoulder member.

In another embodiment, the garment hanger further comprises a cross-member connecting the first and second shoulder members.

There is also provided an improved garment hanger of the type having a pair of elongated shoulder members and a hook for engagement over a supporting rack member, the hook having a shank and a downwardly facing opening, the shoulder members being attached to the shank, wherein the improvement comprises a blocking member extending from the second shoulder member, the blocking member having a bend and an end portion, the end portion being attached to the shank, the blocking member being shaped such that, as the hanger is moved vertically, the blocking member encounters the rack member.

In another embodiment, the bend forms an angle of no more than ninety degrees.

In another embodiment, the garment hanger further comprises a cross-member connecting the first and second shoulder members.

There is also provided an improved garment hanger of the type having a pair of elongated shoulder members and a hook for engagement over a supporting rack member, the hook having a shank and a downwardly facing opening, the shoulder members being attached to the shank, wherein the improvement comprises a blocking member having a first end and a second end, both ends being attached to the shank, the blocking member being shaped such that, as the hanger is moved vertically, the blocking member encounters the rack member.

In another embodiment, the blocking member is curved to form generally parallel sides.

In another embodiment, the garment hanger further comprises a cross-member connecting the first and second shoulder members.

There is also provided an improved garment hanger of the type having a pair of elongated shoulder members and a hook for engagement over a supporting rack member, the hook having a shank and a downwardly facing opening, wherein the improvement comprises means for blocking the rack member during vertical motion of the hanger.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

The blocking member reduces the size of the hook opening and in use with a hook-shaped closet garment hanger device will prevent rotation off of the hook retaining element.

Figure 4:
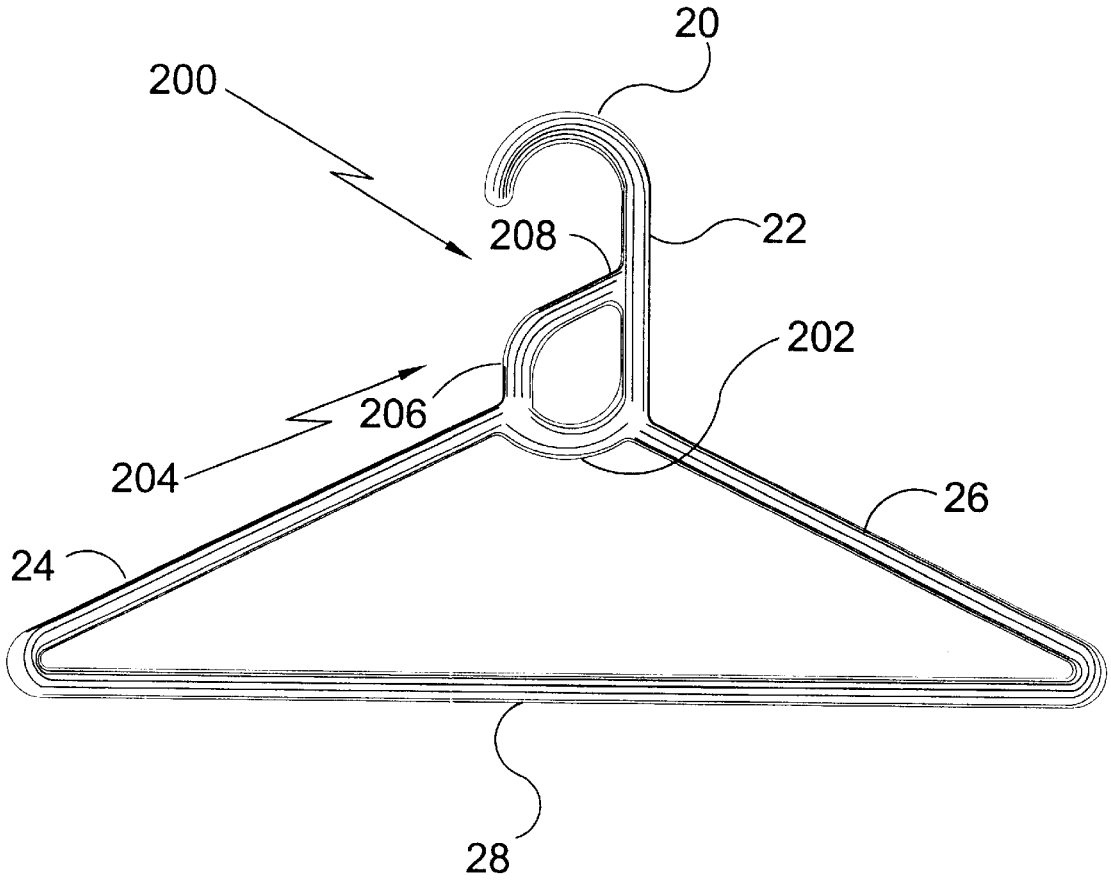

FIG. 4 is a side view of a second embodiment of the garment hanger of the present invention having a blocking member. The blocking member is spaced between the hook and body of the garment hanger.

Figure 5:
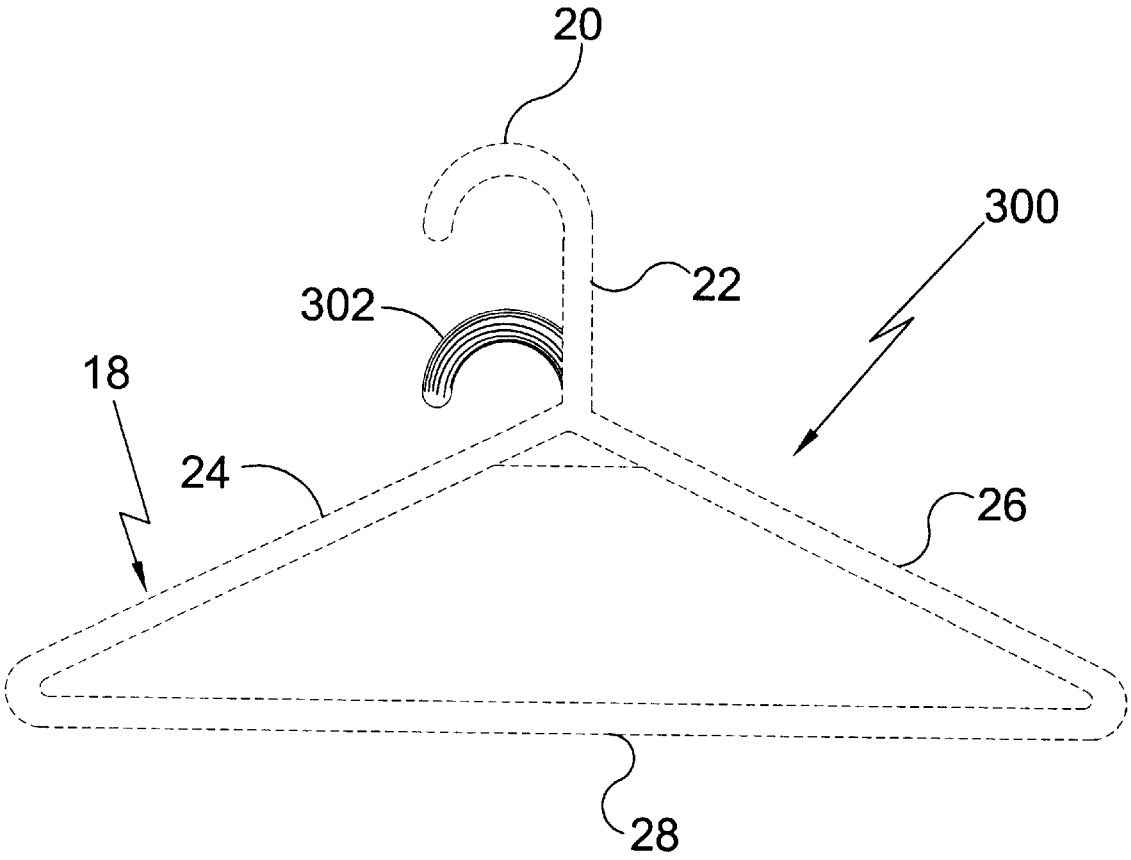

FIG. 5 is a side view of a third embodiment of the garment hanger of the present invention.

Figure 6:
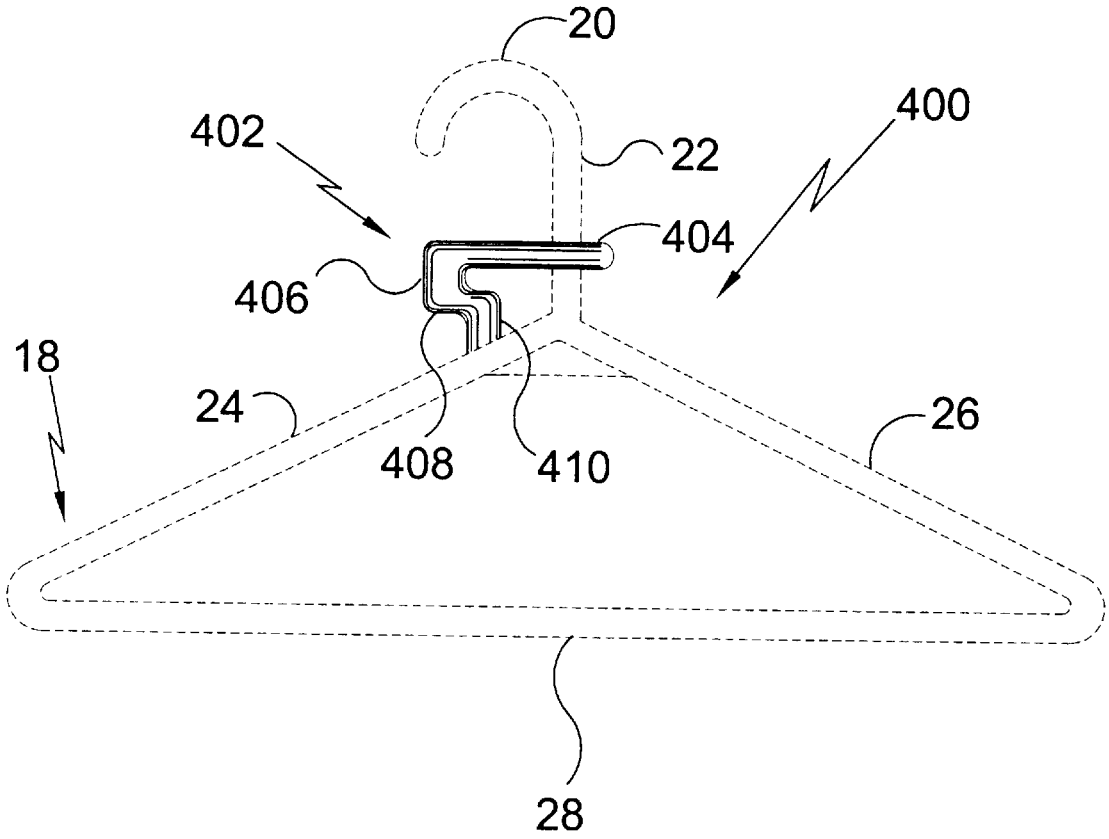

FIG. 6 is a side view of a fourth embodiment of the garment hanger of the present invention.

Figure 7:
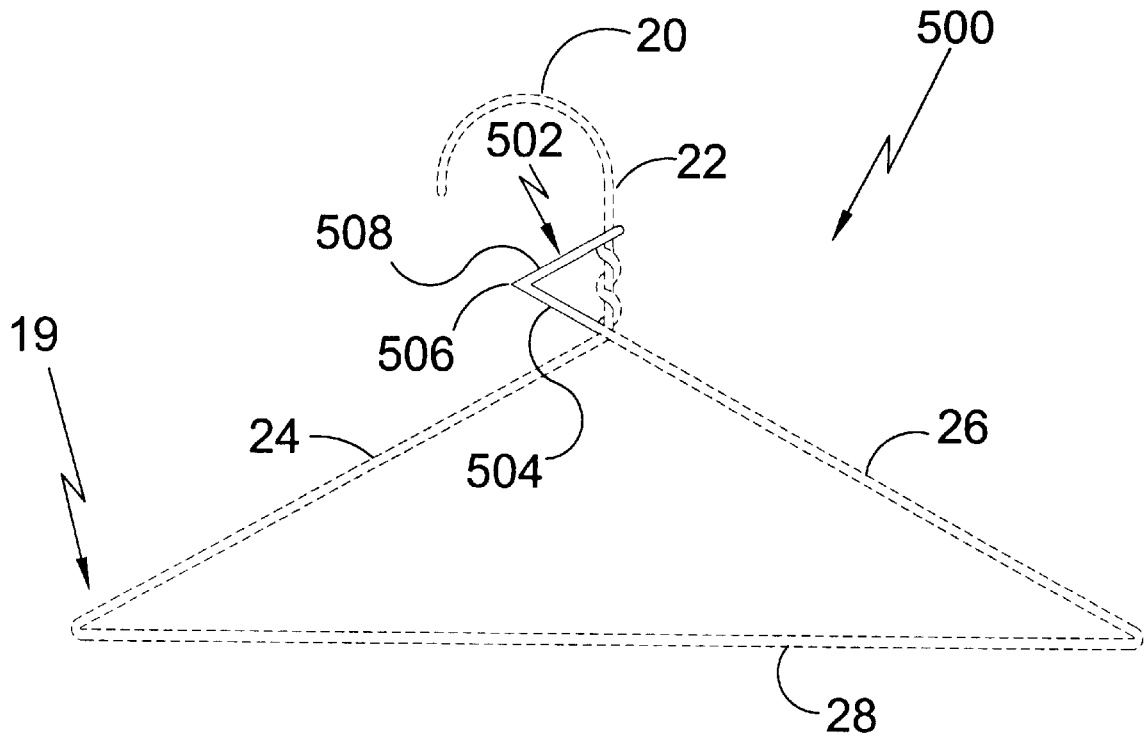

FIG. 7 is a side view of a fifth embodiment of the garment hanger of the present invention.

Figure 8:
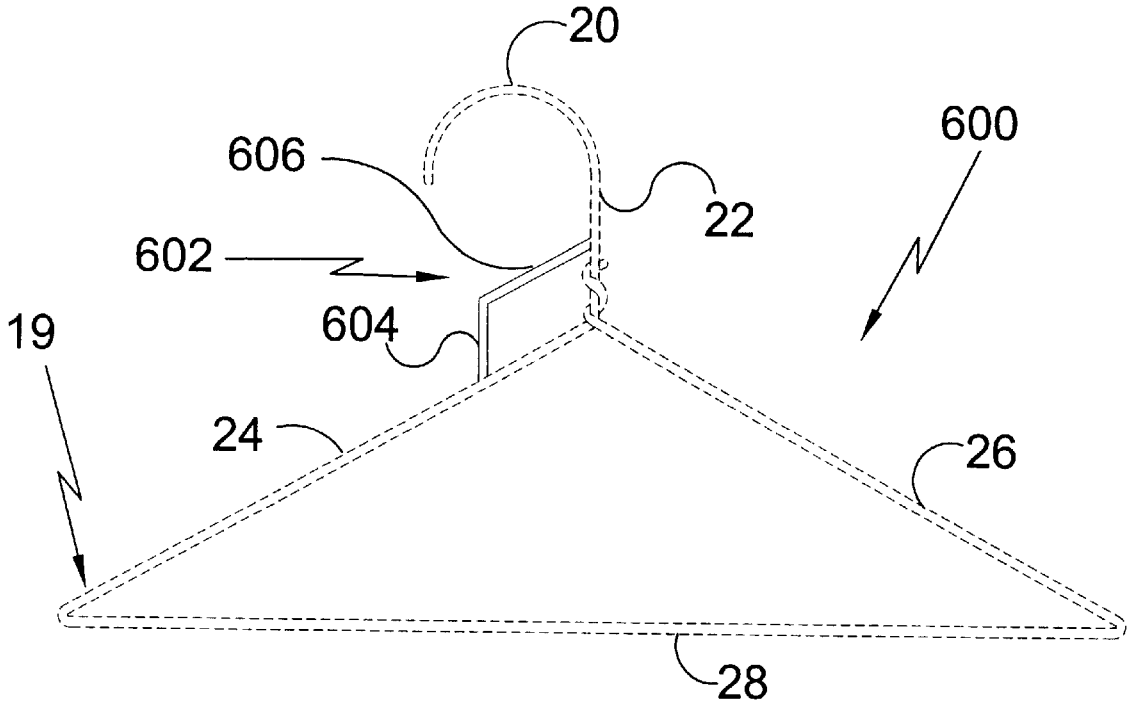

FIG. 8 is a side view of a sixth embodiment of the garment hanger of the present invention.

Figure 9:
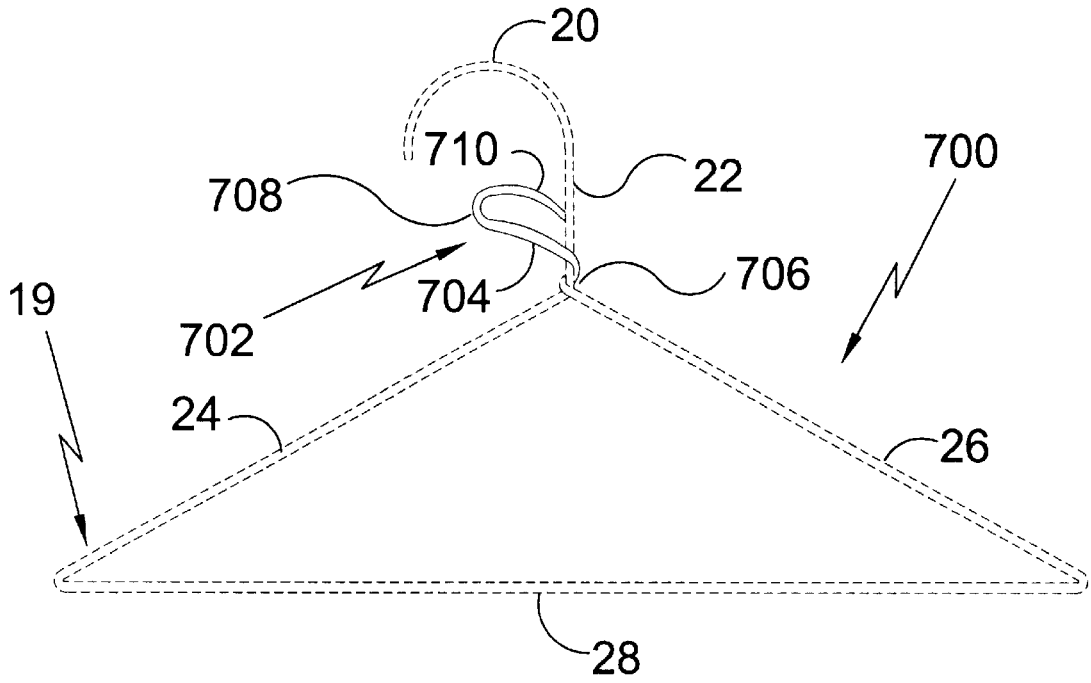

FIG. 9 is a side view of a seventh embodiment of the garment hanger of the present invention.

Figure 10:
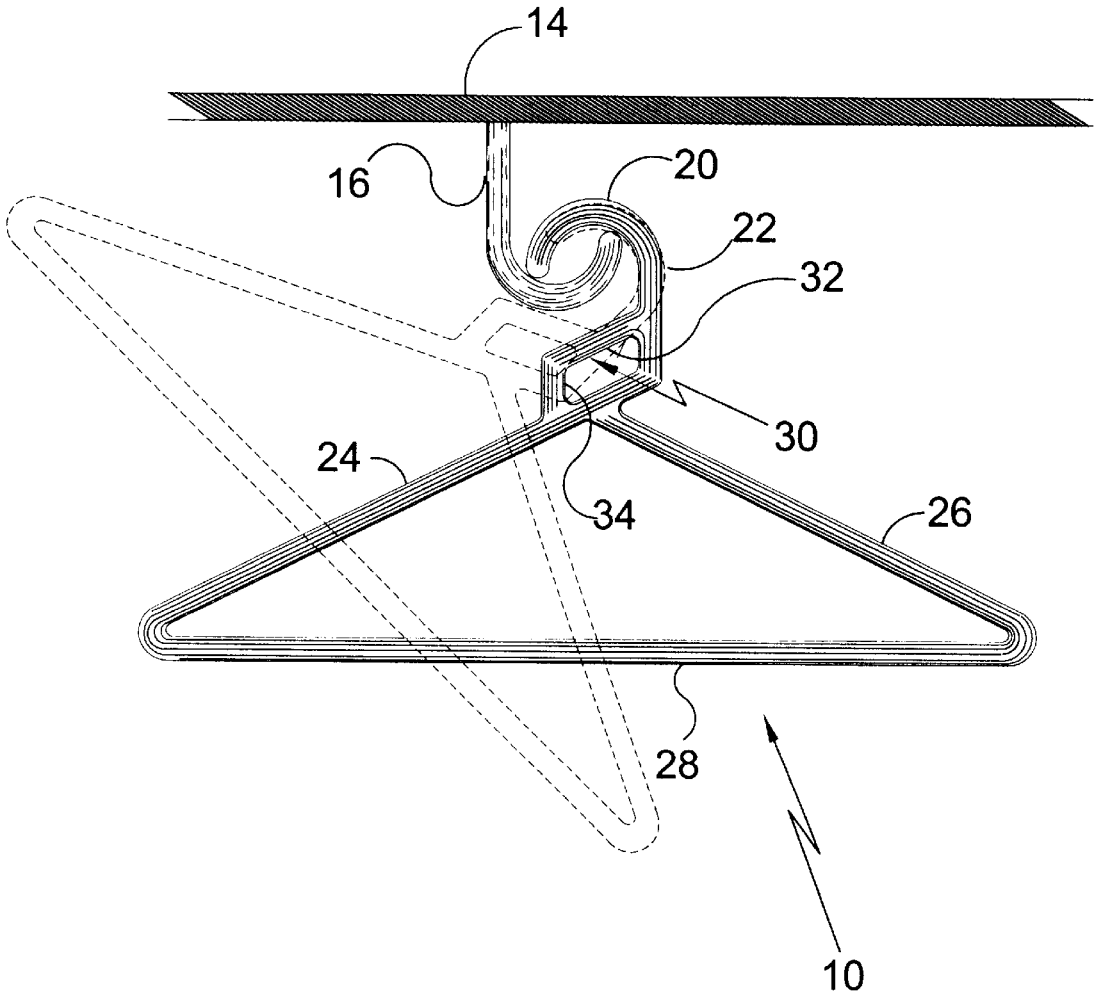

FIG. 10 is a side view of the first embodiment of the present invention hanging from a hook-shaped closet garment hanger rack member. The hanger has a blocking member that engages the closet garment hanger assembly when the hanger is rotated from the first position to the second position, the second position being shown in broken line.

DESCRIPTION OF THE REFERENCED NUMERALS

Turning now descriptively to the drawings, in which similar reference characters denote similar elements throughout the several views, the figures illustrate the Improved Garment Hanger of the present invention. With regard to the reference numerals used, the following numbering is used throughout the various drawing figures.

10 Improved Garment Hanger of the present invention—first embodiment
11 user
12 round hanger rack
14 ceiling/shelf
16 hook-shaped hanger rack
18 typical plastic garment hanger
19 typical wire garment hanger
20 hook
22 shank
24 first shoulder member
26 second shoulder member
28 cross-member
30 blocking member
32 blocking member first portion
34 blocking member second portion
200 second embodiment
202 connecting member
204 blocking member
206 blocking member first end portion
208 blocking member second end portion
300 third embodiment
302 blocking member
400 fourth embodiment
402 blocking member
404 blocking member first portion
406 blocking member second portion
408 blocking member third portion
410 blocking member fourth portion
500 fifth embodiment
502 blocking member
504 blocking member first portion
506 bend
508 blocking member second portion
600 sixth embodiment
602 blocking member
604 blocking member first portion
606 blocking member second portion
700 seventh embodiment
702 blocking member
704 second shoulder wrapped portion extension
706 second shoulder wrapped portion
708 curve second shoulder member wrapped portion extension second portion

DETAILED DESCRIPTION OF THE PREFERRED EMBODIMENTS

Turning now descriptively to the drawings, in which similar reference characters denote similar elements throughout the several views, FIGS. 1–10 illustrate the Improved Garment Hanger of the present invention, in several embodiments, indicated generally by the numerals 10, 200, 300, 400, 500, 600, and 700.

Figure 1:
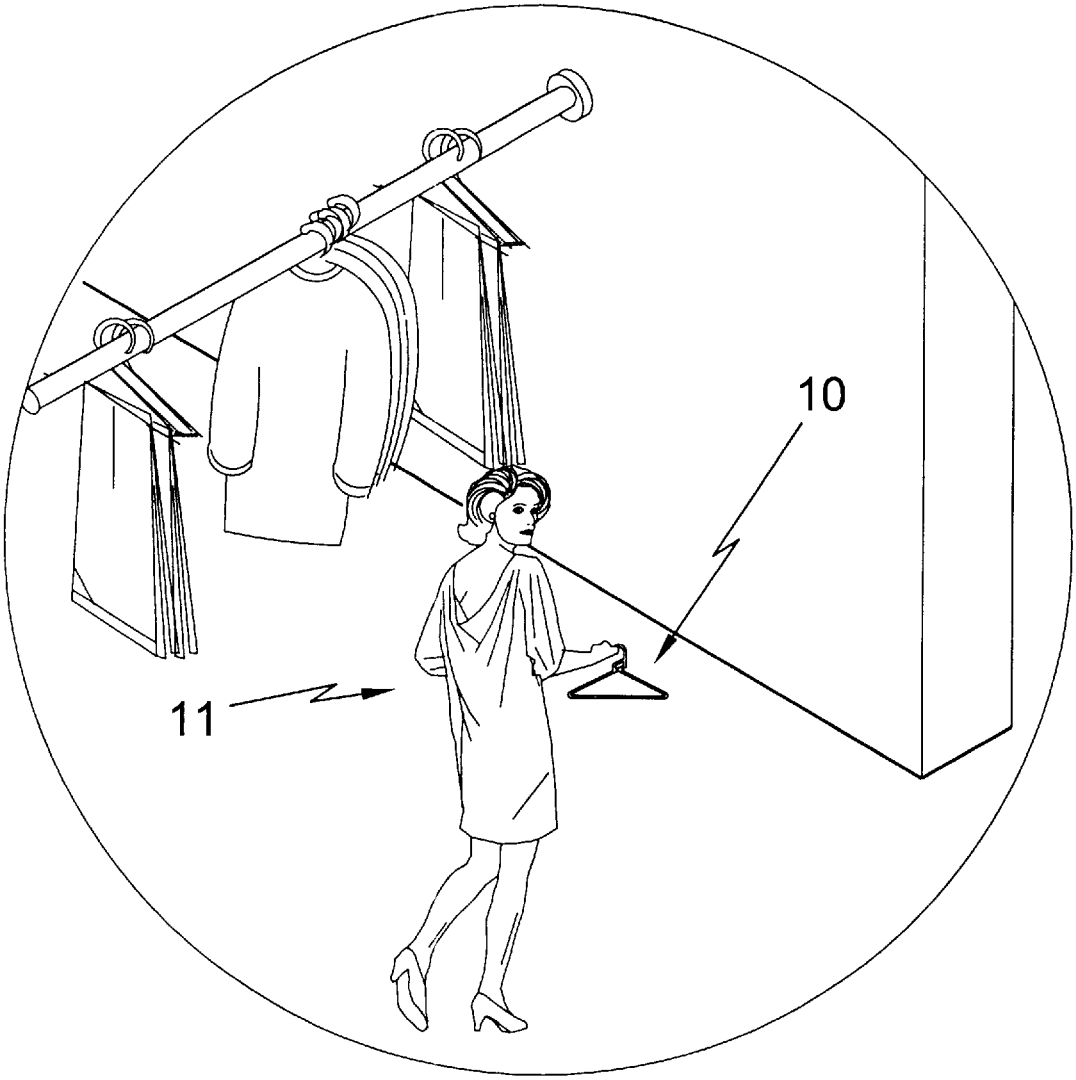
FIG. 1 is perspective view of a plurality of garments within a conventional closet attached to a hanger rack. Also shown is a first embodiment of the garment hanger of the present invention having a hook opening blocking member.
Figure 2:
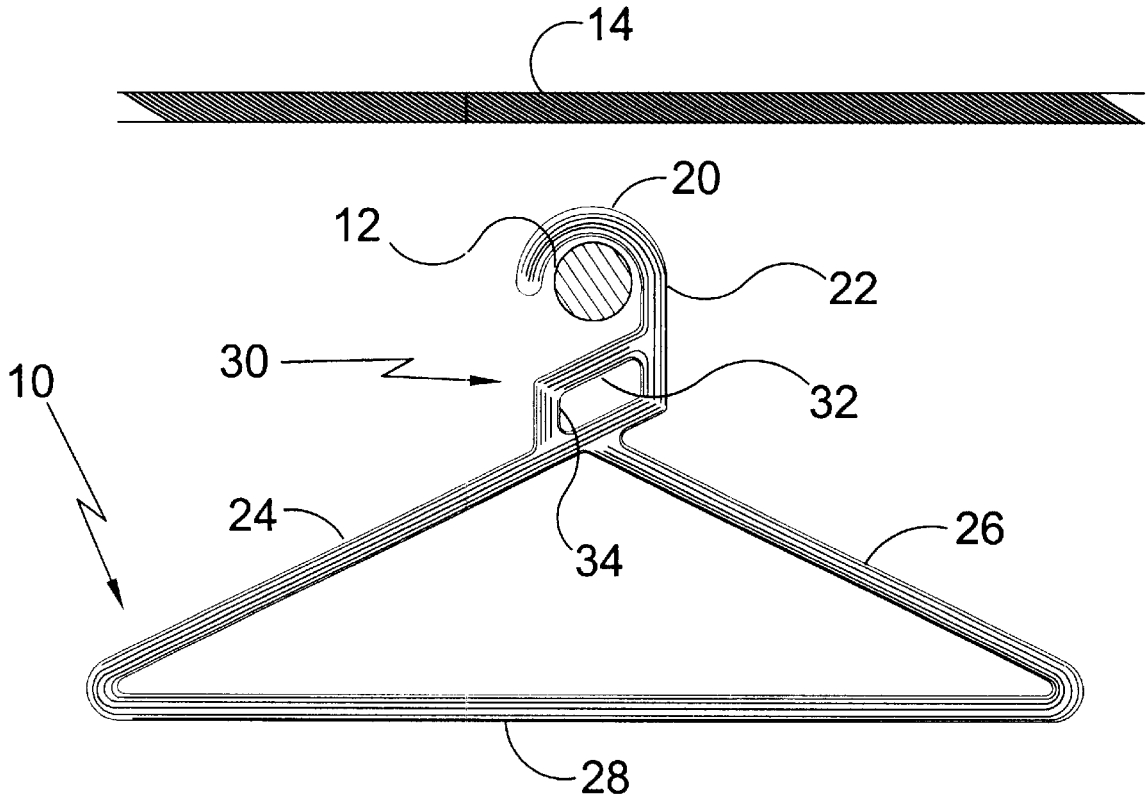
FIG. 2 is a side view of the present invention hanging from a typical round-shaped closet garment hanger rack member. The hanger has a blocking member that engages the closet garment hanger assembly when rotated which simulates actual hanger movement during removal of a garment from the garment hanger.
Figure 3:
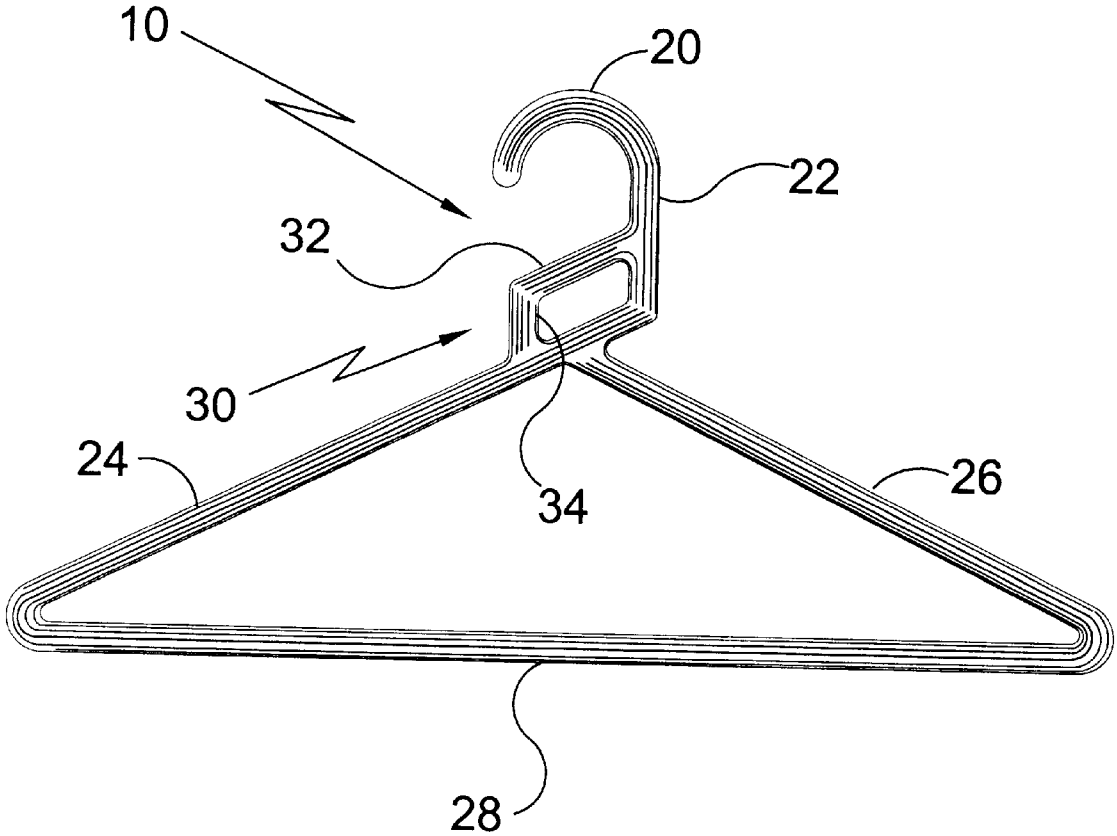
FIG. 3 is a side view of the garment hanger of the present invention having a blocking member. The blocking member is spaced between the hook and body of the garment hanger.

The first embodiment of the hanger 10 is shown generally in FIGS. 1–3 and FIG. 7, and being held by the user 11 in FIG. 1. FIG. 2 depicts a round-shaped supporting hanger rack 12, the rack 12 being suspended from a ceiling/shelf 14. FIG. 10 includes a hook-shaped supporting hanger rack 16, with this embodiment 10 shown in both the normal and pivoted position.

As shown in FIG. 2, this embodiment 10 is an improvement of the typical hanger of the type that has a hook 20, a downwardly extending shank 22, a first shoulder member 24, a second shoulder member 26, and a cross-member 28 that connects the shoulder members 24,26. The hook 20 has a generally downwardly facing opening for receiving the hanger rack 12. This embodiment 10 includes a blocking member 30 with a first portion 32 attached to the shank 22 and a second portion 34 attached to the first shoulder member 24.

In circumstances in which the hanger 10 is moving vertically, the blocking member first portion 32 will encounter the hanger rack 12, thus reducing the likelihood of the hook 20 being displaced from the hanger rack 12.

As shown in FIG. 10, the parallelogram formed by the blocking member 30, the shank 22, and the first shoulder member 24, results in the blocking member first portion 32 encountering the hook-shaped hanger rack 16 when the hanger 10 is pivoting. This reduces the degree of pivot and this also reduces the likelihood of the hanger 10 being displaced from the hanger rack 16.

FIG. 4 depicts a second embodiment 200 that includes an arcuately shaped connecting member 202 than joins the first shoulder member 24 and the second shoulder member 26. A blocking member 204 is included, that has a first end portion 206 joining with the connecting member 202 with the first shoulder member 24, and a second end portion 208 joining with the shank 22. The shank 22 joins with the connecting member 202 and the second shoulder member 26.

The connecting member 202 provides overall structural reinforcement. As in the first embodiment 10, the blocking member 204 encounters the hanger rack 12 when the hanger 200 moves vertically, again reducing the likelihood of the hook 20 being displaced from the hanger rack 12.

A third embodiment 300 is shown in FIG. 5 that includes a curved blocking member 302 fixedly attached to and extending from the shank 22 in a generally parallel orientation with respect to the curve of the hook 20. The blocking member 302 is positioned to encounter the hanger rack 12 during vertical motion of the hanger 300.

A fourth embodiment 400 is shown in FIG. 6. This embodiment 400 includes a blocking member 402 that has a first portion 404 attached to the shank 22 and extending in a generally horizontal direction. A blocking member second portion 406 is attached to the first portion 404 and extends downwardly. A blocking member third portion 408 is attached to the second portion 406 and extends in a generally horizontal direction toward the shank 22. A blocking member fourth portion 410 is attached to the third portion 408 and extends downwardly for attachment to the first shoulder member 24.

The embodiments 300 and 400 are particularly capable of being applied as modifications to a typical plastic hanger 18, such as the one shown in FIGS. 5–6.

FIGS. 7–9 depict three additional embodiments 500,600, 700 that apply the invention in modifications of typical wire hangers 19 having a shoulder member 26 wrapping the shank 22, in a generally helical fashion.

In FIG. 7, for example, the second shoulder member 26 forks at the point the wrapping begins, to form a blocking member 502. A blocking member first portion 504 is formed by the forking of the second shoulder member 26. A bend 506 is then provided that directs the blocking member second portion 508 toward the shank 22 for attachment thereto. The hanging rack 12 encounters the blocking member 502 during vertical motion of the hanger 500.

A sixth embodiment 600 includes a blocking member 602 that has a first portion 604 attached to the first shoulder member 24. A blocking member second portion 606 is attached to the blocking member first portion 604 and the shank 22. As shown in FIG. 8, the blocking member first portion 604 is substantially parallel to the first shoulder member 24, while the blocking member second portion 606 is substantially parallel to the shank 22. The blocking member interferes with the hanger rack 12 during upward motion of the hanger 600.

The fifth and sixth embodiments 500,600 are particularly suited to encounter the hook-shaped hanger rack 16 during a pivoting motion of the hanger 500,600.

FIG. 9 depicts a seventh embodiment 700 in which a blocking member 702 is formed from an extension 704 of the second shoulder member portion 706 that is wrapped about the shank 22. A curve 708 causes a second portion 710 of the extension to be directed back to the shank 22 for attachment.

The improved hangers 10,200,300,400,500,600,700 can be constructed without the cross-member, and can be constructed from various materials, including, but not limited to, various plastics, woods, and metals, all in accordance with the present invention, and as determined by the intended end use for the overall device, as will occur to those of skill in the art upon review of the present disclosure.

It will be understood that each of the elements described above, or two or more together may also find a useful application in other applications differing from that described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An improved garment hanger of the type having a pair of elongated shoulder members and a hook for engagement over a supporting rack member, the hook having a shank and a downwardly facing opening, the shoulder members being attached to the shank, wherein the improvement comprises a blocking member having a first end attached to the shank and a second end attached to one of the shoulder members, the blocking member being shaped such that, as the hanger is moved vertically, the blocking member encounters the rack member, with the blocking member further comprising a first, second, third and fourth portion, the first portion extending in a substantially horizontal direction from the shank, the second portion being attached to the first portion and extending downwardly, the third portion being attached to the second portion and extending in a substantially horizontal direction toward the shank, and the fourth portion being attached to the third portion and extending downwardly for further attachment to the first shoulder member.

* * * * *